US009284736B1

(12) United States Patent
Preuss

(10) Patent No.: US 9,284,736 B1
(45) Date of Patent: Mar. 15, 2016

(54) COMPOSITE SIDING WITH IMPROVED INTERLACED END-GRAIN CORNER CONFIGURATION AND FALSE CHINKING JOINT

(71) Applicant: Gunter Preuss, Loveland, CO (US)

(72) Inventor: Gunter Preuss, Loveland, CO (US)

( * ) Notice: Subject to any disclaimer, the term of this patent is extended or adjusted under 35 U.S.C. 154(b) by 0 days.

(21) Appl. No.: 13/632,909

(22) Filed: Oct. 1, 2012

Related U.S. Application Data

(60) Provisional application No. 61/541,855, filed on Sep. 30, 2011.

(51) Int. Cl.
*E04F 13/10* (2006.01)
*E04B 2/70* (2006.01)

(52) U.S. Cl.
CPC ..... *E04F 13/10* (2013.01); *E04B 2/702* (2013.01)

(58) Field of Classification Search
CPC ..... E04F 13/0864; E04B 2/702
USPC ..... 52/233, 586.1, 585, 586.2
See application file for complete search history.

(56) References Cited

U.S. PATENT DOCUMENTS

| | | | | | |
|---|---|---|---|---|---|
| 1,996,735 | A | * | 4/1935 | King | 52/233 |
| 4,012,876 | A | * | 3/1977 | Grubbs | 52/233 |
| 4,277,925 | A | * | 7/1981 | Kinser | 52/233 |
| 4,320,610 | A | * | 3/1982 | Rupp | 52/233 |
| 4,569,873 | A | | 2/1986 | Robbins | |
| 4,627,204 | A | | 12/1986 | Smith | |
| 4,840,003 | A | * | 6/1989 | Lucas et al. | 52/233 |
| 4,844,763 | A | | 7/1989 | Robbins | |
| 4,864,787 | A | | 9/1989 | Bukowski | |
| 4,878,328 | A | | 11/1989 | Berge | |
| 4,918,888 | A | * | 4/1990 | Giles et al. | 52/233 |
| 5,010,701 | A | | 4/1991 | Halsey et al. | |
| 5,029,425 | A | | 7/1991 | Bogataj | |
| 5,167,103 | A | | 12/1992 | Lindal | |
| 5,363,621 | A | | 11/1994 | Kroll et al. | |
| 5,448,865 | A | | 9/1995 | Palmerstein | |
| 5,502,939 | A | | 4/1996 | Zadok et al. | |
| 5,522,193 | A | | 6/1996 | Sommerstein et al. | |

(Continued)

FOREIGN PATENT DOCUMENTS

WO WO02070341 A2 9/2002

OTHER PUBLICATIONS

U.S. Appl. No. 61/541,855, filed Sep. 30, 2012, entitled Composite Siding with Interlaced End-Grain Corner Configuration.

(Continued)

*Primary Examiner* — Brian Glessner
*Assistant Examiner* — Paola Agudelo
(74) *Attorney, Agent, or Firm* — Santangelo Law Offices, P.C.

(57) ABSTRACT

The invention relates to a composite siding system with interlaced end-grain corner configuration that more accurately simulates the appearance of solid or shaped wood log siding. The invention provides for a series of alternating horizontal siding elements which may be joined to a pre-constructed structure utilizing an improved interlaced end-grain corner configuration. The inventive technology specifically describes a composite siding panel system with an improved interlaced end-grain corner configuration having an internally securable fitted corner joint connection. Additionally, the invention describes a composite siding panel system with a false chinking joint as well as modifications to mitigate moisture expansion type joint damage.

19 Claims, 11 Drawing Sheets

(56) References Cited

U.S. PATENT DOCUMENTS

| | | | | |
|---|---|---|---|---|
| 5,577,357 | A | 11/1996 | Civelli | |
| 5,638,649 | A | 6/1997 | Hovland | |
| 6,000,177 | A | 12/1999 | Davidson | |
| D419,246 | S | 1/2000 | Lane et al. | |
| 6,189,271 | B1 | 2/2001 | Christensen | |
| D449,121 | S | 10/2001 | Hunter et al. | |
| 6,314,701 | B1 | 11/2001 | Meyerson | |
| 6,427,414 | B1 * | 8/2002 | Wing | 52/590.1 |
| 6,684,587 | B2 | 2/2004 | Shaw et al. | |
| D519,651 | S | 4/2006 | Simic | |
| 7,043,884 | B2 | 5/2006 | Moreno | |
| 7,188,456 | B2 | 3/2007 | Knauseder | |
| D576,315 | S | 9/2008 | Mock et al. | |
| 7,966,783 | B2 | 6/2011 | Wilson et al. | |
| D670,824 | S * | 11/2012 | Preuss | D25/139 |
| D681,236 | S | 4/2013 | Preuss | |
| 9,045,909 | B1 | 6/2015 | Preuss | |
| 2002/0050114 | A1 | 5/2002 | Friso | |
| 2002/0121064 | A1 | 9/2002 | Erwin | |
| 2003/0037504 | A1 | 2/2003 | Shwitte et al. | |
| 2003/0041545 | A1 | 3/2003 | Stanchfield | |
| 2003/0145550 | A1 | 8/2003 | Bennett et al. | |
| 2004/0031226 | A1 | 2/2004 | Miller et al. | |
| 2004/0187412 | A1 * | 9/2004 | McCain | 52/233 |
| 2006/0032167 | A1 | 2/2006 | Cecillo et al. | |
| 2006/0096217 | A1 | 5/2006 | Lance et al. | |
| 2007/0204538 | A1 * | 9/2007 | Miller et al. | 52/233 |
| 2007/0245652 | A1 | 10/2007 | Lechasseur | |
| 2008/0127583 | A1 * | 6/2008 | Wrightman et al. | 52/233 |
| 2008/0295439 | A1 | 12/2008 | Janesky | |
| 2009/0199497 | A1 * | 8/2009 | Wrightman | 52/233 |
| 2009/0293373 | A1 * | 12/2009 | Klinkhamer et al. | 52/79.9 |
| 2009/0293407 | A1 * | 12/2009 | Swanson | 52/589.1 |
| 2013/0008107 | A1 * | 1/2013 | Herman | 52/233 |

OTHER PUBLICATIONS

Related U.S. Appl. No. 29/403,824, filed Oct. 11, 2011; notice of allowance dated Dec. 12, 2012.

Related U.S. Appl. No. 29/403,113, filed Sep. 30, 2011; notice of allowance dated Sep. 12, 2012.

United States Patent and Trademark Office; Office Action dated Dec. 11, 2013; U.S. Appl. No. 13/648,943.

United States Patent and Trademark Office; Office Action dated Apr. 3, 2013; U.S. Appl. No. 13/648,943.

* cited by examiner 16
15
17

5
14

6
4
22
1
22
6

4
6
22
2a
6

4
14
22

3
22
6
1
2b
6

15
17
16

5
14

12
1
2b
14
14
1
15
17
3
3
22
22
4
4
5
5

COMPOSITE SIDING WITH IMPROVED INTERLACED END-GRAIN CORNER CONFIGURATION AND FALSE CHINKING JOINT

This application claims the benefit of and priority to U.S. Provisional Application No. 61/541,855 file Sep. 30, 2011. The entire specification and figures of the above-referenced application is hereby incorporated, in its entirety by reference.

TECHNICAL FIELD

The present inventive technology generally relates to the field of building construction. More specifically, the invention relates to a composite siding with interlaced end-grain corner configuration that may more accurately simulate the appearance of solid or shaped wood log siding. The invention provides for a series of alternating horizontal siding elements which may be joined to a pre-constructed structure utilizing an improved interlaced end-grain corner joint configuration. Such improved interlaced corner configuration provides an improved aesthetic and realistic appearance without artificial joints and/or seams while presenting an unaltered end-grain presentation similar to traditional whole-log construction techniques. Additional embodiments of the inventive technology include a composite siding with interlaced end-grain corner configuration having a false chinking joint which again, provides for the realistic appearance of traditional whole-log construction while utilizing inexpensive and structurally simple to assemble elements. In some embodiments such false chinking joint may be constructed so as to be pliant allowing for greater expansion as well as sheer and torsional movement on the false chinking joint which may occur as a result of water penetration and/or expansion as well as natural settling effects.

BACKGROUND OF THE INVENTION

Traditional shaped or whole log constructed buildings are common throughout the world. In such buildings, solid or shaped logs are placed one on top of the other to build up the external or perhaps even internal wall structure. Traditionally the gap between the logs, or chink joint (chinking joint) would be filled or sealed, closing the external structural of the building. Following this sealing step, various internal and/or external finishing embellishments may be added as desired. While shaped or whole log buildings were initially constructed due to the limitations of then existing construction techniques and materials, such traditional log homes have most recently been replaced with more efficient frame structures. However, due to various visual and functional aspects of such shaped and/or whole log constructed buildings, there remains a strong demand within the market to combine modern frame construction techniques with traditional shaped or whole log aesthetics.

The industries first attempts to hybridize conventional and log building construction techniques involving shaped log siding where elongated panels would be placed horizontally along the outer surface of a pre-fabricated wall. In some instances a rounded or curved structure simulating a log surface appearance would be attached to such a panel. However, such siding systems have several drawbacks, namely that the aesthetic appearance of these "simulated" surfaces to not give the appearance of authentic log construction. This is especially apparent at the buildings corners where the elongated panels intersect and terminate. As a result, a variety of corner systems have been developed to simulate the corner intersection of such structures. Many typically employ "false" structures to present the appearance of the tell-tale staggered log intersections.

A prior solution has been the attachment of solid log sections to the sheathing boards at the building corner. This method proved time consuming and costly since each segment of "log" had to be profiled to provide a close fit with its respective siding piece. Another limited solution was the installation of vertical corner posts connecting to horizontal siding as generally described in U.S. Pat. Nos. 4,277,925 and 5,167,103. However, this approach could not provide wood grain patterns that closely mimic true log construction limiting their functional and aesthetic capabilities. Another approach described in U.S. Pat. Nos. 4,627,204 and 4,320,610 utilized simulated log pieces or full log end pieces arranged in a vertical column and secured to the corner of the building to simulate the look of full log cornet joint. Similarly, in U.S. Pat. Nos. 4,096,674 and 2,005,921 false mortise and tenon structures were secured to a building corner to present the appearance of a full log structure. However each such method has been limited in its industry adoption due to the increased complexity and cost as well as un-realistic appearance.

Another potential solution was proposed in U.S. Pat. No. 1,996,735 which related to construction with horizontal siding units and corner blocks made to resemble saddle-V notches. The siding was nailed both to the frame and to the corner block and the joint between the corner block and siding was a mitered 45-degree angle, which chips out in the in-grain block. Finally, a more recent approach found in U.S. Pat. No. 6,427,414 secured corner pieces with internally positioned splines into a specific cut-out on alternating horizontally placed boards that were attached though specific H-joints to a prefabricated surface and using a chamber to hide the a corner joint and lack of grain continuity. However, again, such approach required additional and complicated steps and require a chambered structure which is inconsistent with more traditional log-construction aesthetics.

The foregoing problems and limitations regarding conventional corner systems for shaped and log construction techniques may represent a long-felt need for a simple and cost-effective solution that preserves the traditional log-construction aesthetic. In addition, such systems do not address a simple and cost-effective solution for creating a false chinking joint which may further be engineered to be pliant such that it may aid in making it more resistant to water penetration and expansion as well as other stresses that might damage the joint structure. While implementing elements may have been available as shown above, actual attempts to meet this need may have been lacking to some degree. This may have been due to a failure of those having ordinary skill in the art to fully appreciate or understand the nature of the problems and challenges involved. As a result of this lack of understanding, attempts to meet these long-felt needs may have failed to effectively solve one or more of the problems or challenges here identified. These attempts may even have led away from the technical directions taken by the present inventive technology and may even result in the achievements of the present inventive technology being considered to some degree an unexpected result of the approach taken by some in the field. As such, the current inventive technology provides a single comprehensive solution, which in some embodiments is expressed throughout.

SUMMARY OF THE INVENTION

It is therefore an object of the present invention to provide a composite siding system with an interlaced end-grain corner configuration that may be constructed over conventional or prefabricated walls or building frames providing the aesthetic appearance of a shaped log structure with a realistic end-grain presentation. Another object of the present invention is to provide a composite mounting system that reduces material and installation costs while increasing attachment support through a composite configuration with the underlying structure.

Another object of the present invention is to provide a composite mounting system that presents a continuous end-grain presentation more accurately mimicking the aesthetic appearance of a shaped log structure. Another object of the present invention is to provide an internal connection that provides a simple fitted external joint aligning system between the terminal facade cap and a siding panel. Another object of the present invention is to provide a composite mounting system that that can mount horizontally placed siding panels with an interlaced corner configuration without the need for any additional fasteners. Another object of the present invention is to provide a composite mounting system that can present an interlaced corner end-grain configuration without the need to angle or otherwise alter the terminal facade cap and/or siding panel to hide inconsistent wood grain presentation.

Additional objects of the present invention provide a false chinking joint between stacked composite siding panels providing the aesthetic appearance of a shaped log structure. Another object of the present invention is to provide a pliant false chinking joint that is more resistant to water adsorption/penetration and expansion as well as other sheer and/or torsional stresses. Naturally, further objects of the inventive technology will become apparent from the description and drawings below.

DETAILED DESCRIPTION OF THE INVENTIVE TECHNOLOGY

The present invention includes a variety of aspects, which may be combined in different ways. The following descriptions are provided to list elements and describe some of the embodiments of the present invention. These elements are listed with initial embodiments, however it should be understood that they may be combined in any manner and in any number to create additional embodiments. The variously described examples and preferred embodiments should not be construed to limit the present invention to only the explicitly described systems, techniques, and applications. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

Figure 1:
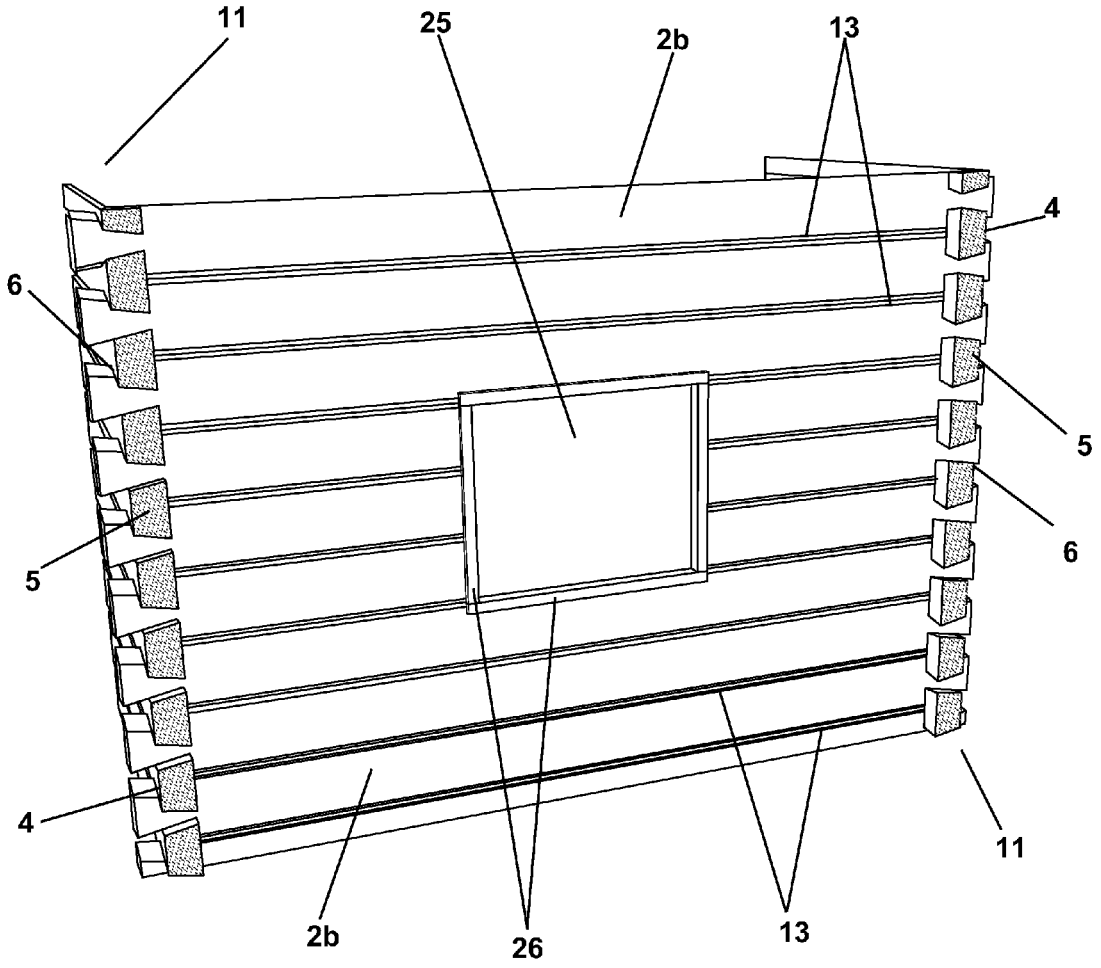
FIG. 1: is a front perspective view of an exemplary wall constructed from said composite siding panels with and interlaced end-grain corner configuration having an internally positioned opening in one embodiment thereof.

Generally referring to FIG. 1, the present invention may include methods and apparatus for a composite siding panel (1) with interlaced end-grain corner joint configuration (11) that may be constructed over a pre-fabricated or sheathed wall to provide the appearance of a traditional shaped log structure. In certain embodiments this interlaced end-grain corner configuration (11) (the terms being interchangeable) may be formed by horizontally stacking a series of composite siding panels (1) over a frame structure with a first and second wall intersecting at a substantially right angle. As generally shown in FIG. 1, such substantially perpendicular composite siding panels (1) may have individual tapered interlaced joints (3) at their terminal ends which may further be secured with a terminal façade cap (4) forming an interlaced joint surface (11) and externally presenting an end-grain surface (5) substantially perpendicular to the composite siding panel (1). These interlaced joint surfaces (11) may be alternatively interlaced by placement of alternating composite siding panels (1) intersecting at substantially right angles forming said interlaced end-grain corner joint configuration (11) as shown. In addition, as can be seen in FIG. 1, such a configured composite wall may be configured to present a false chinking joint (13) to provide the appearance of traditional whole-log construction. As will be discussed below, in certain embodiments such false chinking joint (13) may be pliantly constructed forming a pliant false chinking joint (29). Finally, in certain embodiments as shown in FIG. 1, such composite siding may be modified to insert traditional internal openings (4) secured with internal opening casing (14). Additional specific embodiments will be taken up in turn.

Generally referring to FIGS. 2-6, certain embodiments may include individual composite siding panels (1) that may form a larger composite siding wall or structure. As showing in FIG. 1, the interlaced end-grain corner configuration may initially comprise elongated composite siding panels (1). Such composited siding panels may be constructed from traditional wood products, such as hard-wood and/or plywood; however, such panels may in fact be formed from any appropriate synthetic material such as synthetic wood and/or wood plastic composites. Such wood-plastic composites may generally encompass composite materials made of wood fiber/flour and thermoplastic(s) which may include, but are not limited too: high-density polyethylene composites; low-density polyethylene composite; polyvinyl chloride (PVP) composite; polypropylene (PP) composite; acrylonitrile butadiene styrene (ABS) composite; polystyrene (PS) composite; polylactic acid (PLA) composite; thermoplastic composite; and recycled thermoplastic composite.

In a preferred embodiment, such composite siding panels (1) may be engineered to have an interior or internal panel surface (2*a*) that may be placed flush with said sheathed wall, and an exterior external panel surface (2*b*), which may present a solid and/or shaped appearance such as a flat external panel surface as shown generally in FIG. 1, or rounded external panel surface similar to traditional whole-log construction. It should be noted that such a flat external panel surface may include finished surfaces as well as substantially flat surfaces that have been artificially "shaped" to provide, for example, a "hewn" panel seen in traditional flat-panel log-construction. Such external surfaces may be finished with stain, sealant, wood-grain presentation and/or other embellishments establishing the outer surface.

Additionally, such composite siding panels (1) may incorporate a panel stacking attachment (12) to facilitate the stacking and/or attachments of such composite siding panels (1) to a pre-existing surface such as a pre-fabricated building or even a sheathed wall, the latter providing a protective barrier between the pre-existing surface and the encapsulating composite siding panels (1). In certain embodiments such a panel stacking attachment (12) may be integral to the composite siding panels (1), such as a tongue and groove configuration running the length of the top and bottom of the panel body. Such a panel stacking attachment (12) may be formed by known machining processes and in a preferred embodiment a single composite plank may be initially pre-machined to create a panel stacking attachment (12) along the top and bottom length of the panel body. In this manner, as contemplated, such composite siding panels (1) may be horizontally stacked with the upper "tongue" being inserted, for example, into a lower "groove." Such a joint may be flush, or may be off-set allowing such void to be filled with perhaps chinking material or other embellishments or sealants as desired. In other embodiments such panel stacking attachment (12) may be separately attached as a non-integral panel stacking attachment (not shown). Finally, in some embodiments, such panel stacking attachment (12) may encompass integral and or non-integral surface attachments that may provide an anchor point for said composite siding panel (1) to be anchored to a pre-existing surface perhaps through, for example, such as known construction adhesives (wood glue), self-tapping screws or standard nails and the like.

In some embodiments these panel stacking attachment(s) (12) may provide a corresponding position for the placement of a composite fastening insert (not shown). Such an insert may be fastened to said composite siding panel (1) along the length of said panel stacking attachment (12) by suitable fastening methods, such as known construction adhesives (wood glue), self-tapping screws or standard nails and the like. Such an insert(s) may generally run the length of the panel and provide an overhanging surface on the interior portion of the composite siding panel (1) which may be placed flush with the surface of a pre-existing wall, such as a sheathed wall and provide a strengthened point of attachment for the composite panel's horizontal placement. Additional embodiments may include a non-continuous lengthwise placement of multiple individual composite fastening inserts (not shown) along the length of a panel stacking attachment (12), for example, in a tongue and groove configuration with the panels, to provide individual point of attachment positions, again, for the composite panel's horizontal placement along a sheathed wall.

Further, as shown in FIG. 1, as discussed above, placement of said composite siding panels (1) in a horizontal fashion utilizing a panel stacking attachment (12) along one wall may create a gap or chink joint. In some embodiments the external opening of said chink joint may be approximately 1"-2" inches across, while the internal surface of the chink joint formed by the abutment of opposing internally positioned composite fastening inserts, or natural gap formed by the spaced placement of the horizontally stacked panels, may be substantially smaller, perhaps, approximately 5/16" inches. In this manner, a chink joint is created with increased internal wall covering while using correspondingly less wood plank material. Such a configured chink joint may more readily accept and hold an appropriate caulking and/or fitted strips of insulating material, reducing cost and finishing time and increasing the insulation profile of the composite siding system. Further, as can be seen, in embodiments where such chink joint is created through placement of a composite fastening insert, the exterior surface of said insert may provide an abutting surface for the formed chink joint providing a staggered surface to facilitate the addition of and securement of fill material.

Again, generally referring to FIG. 1, a composite fastening insert may be generally hidden from view by chinking material. In certain embodiments such inserts may be constructed of a durable and less expensive material such as plywood or other wood-plastic composites described above. This composite aspect of the invention provides significant cost savings as it allows for the area extension of the composite siding panels (1), in particular, along their width at a reduced cost. This aspect not only allows for less expensive and durable materials to provide a stronger surface point of attachment to a pre-existing surface such as a pre-fabricated and/or sheathed wall, but allows for a reduced width of the wood plank being utilized resulting in obvious cost savings. In addition, as would be appreciated by those in the construction industry, commodity woods, such as those that may be utilized for the siding panels of the current invention are extremely costly and come only in standard sizes. By extending the area width of such composite siding panels (1) with a composite fastening insert (or false chinking joint insert as discussed below), a builder can employ the current invention, achieving the desired whole-log appearance with interlaced end-grain corner configuration using smaller standard sized wood planks at a significant cost savings.

Figures 2A, 2B, 2C, 2D, 2E, 2F, 2G, 2H:
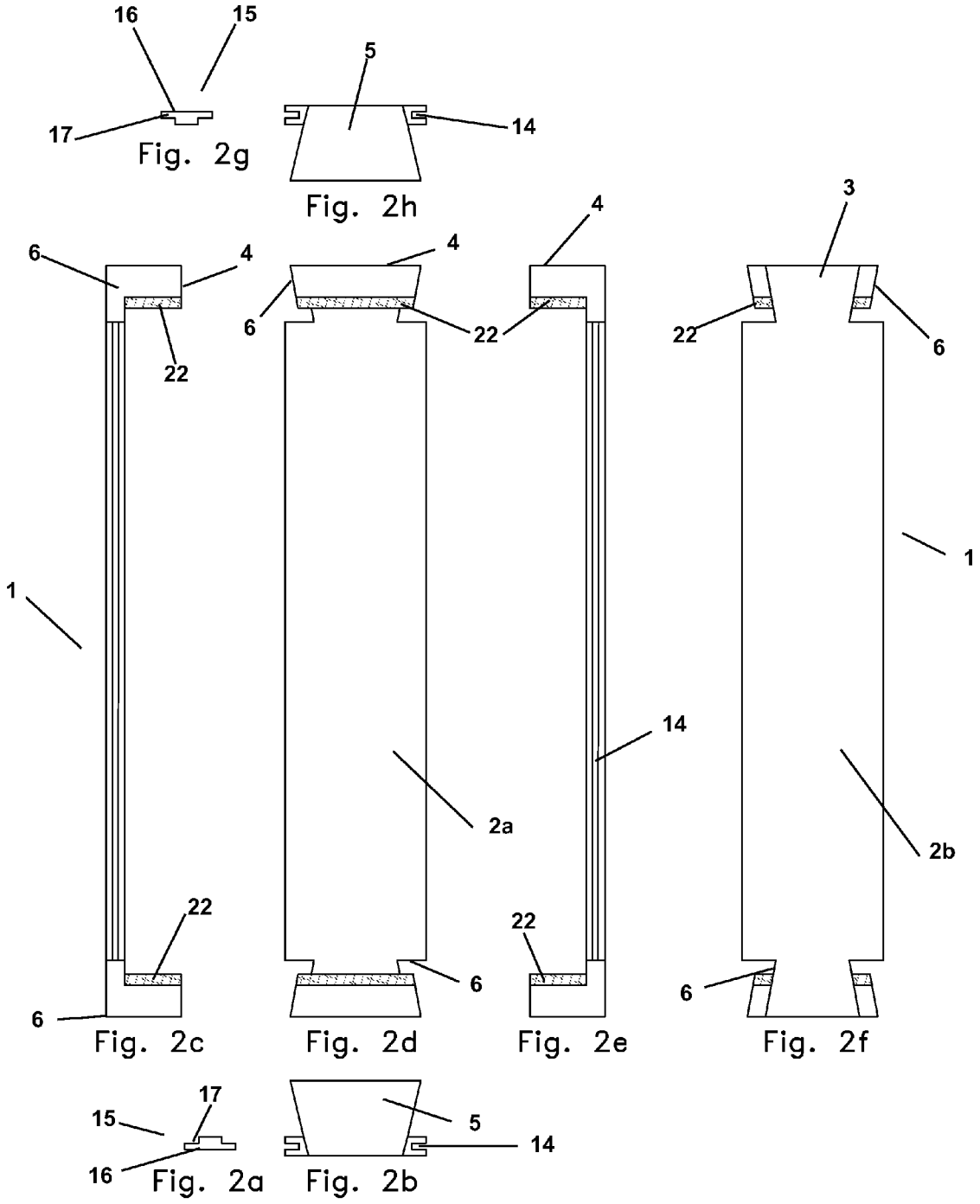
FIG. 2*a*-2*h*: are various views of individual composite siding panels with end-grain corner configurations in one embodiment thereof.
Figures 3A, 3B, 3C, 3D:
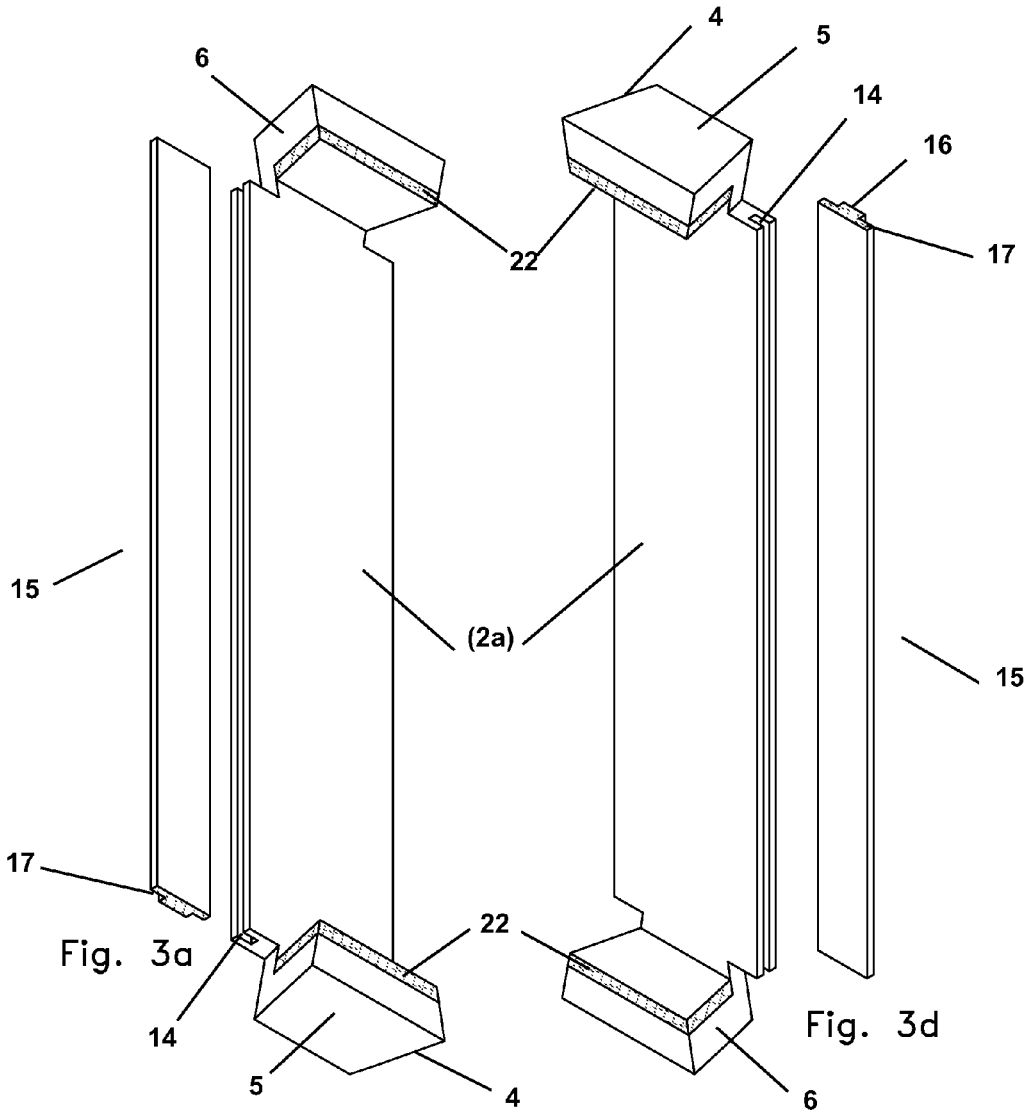
FIG. 3*a*-3*d*: are multiple internal perspective views of individual composite siding elements with false chinking joint inserts in one embodiment thereof.
Figures 4A, 4B, 4C, 4D:
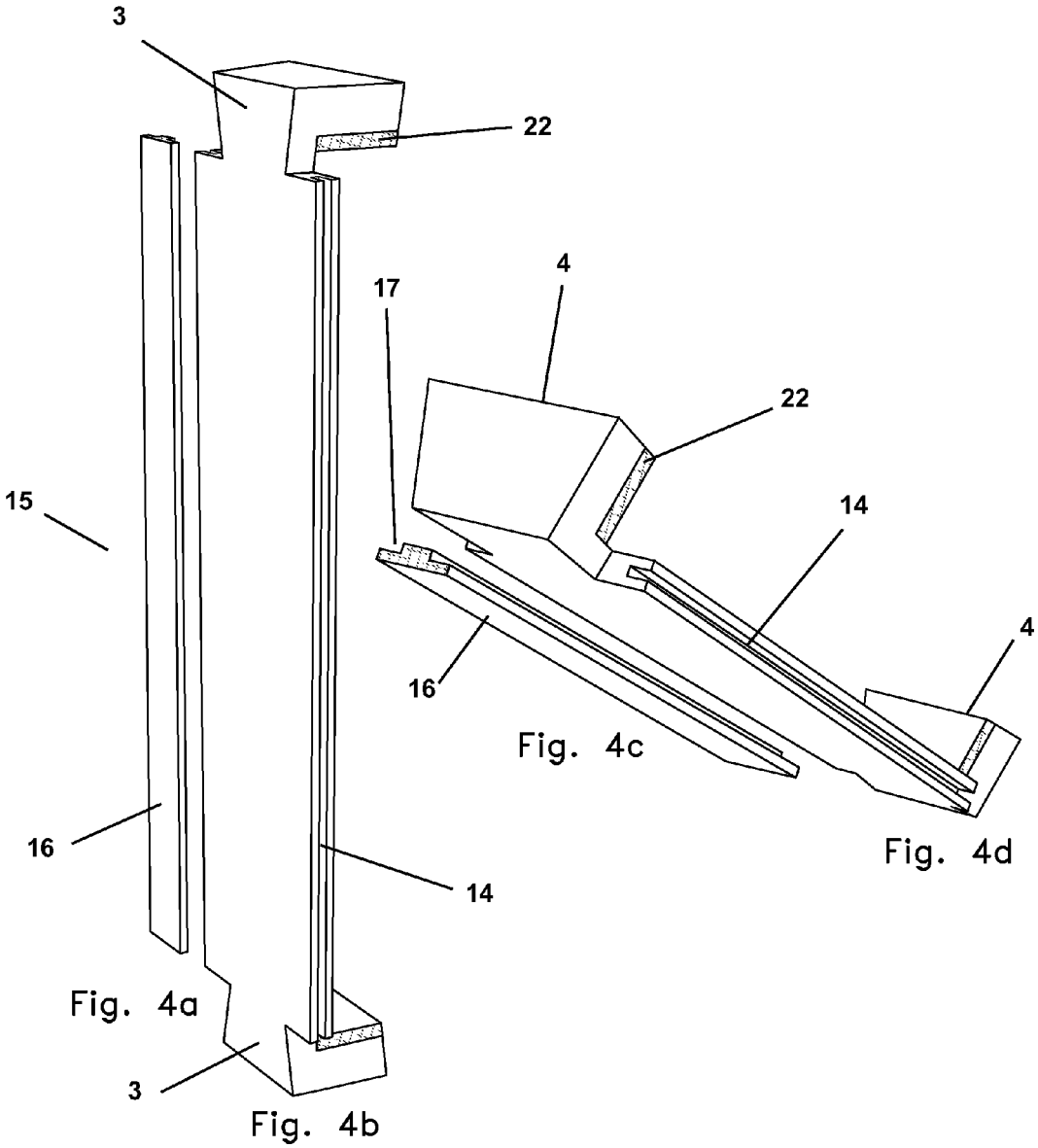
FIG. 4*a*-4*d*: are multiple external perspective views of individual composite siding elements with false chinking joint inserts in one embodiment thereof.

Referring now generally to FIGS. 2-4, the present inventive technology, as described above may encompass individual component composite siding panels (1) having an external panel surface (2*b*) configured to present a solid and/or shaped wood log siding as well as an internal panel surface (2*a*) configured to be joined to a pre-existing surface. In a preferred embodiment, each composite siding panel (1) may have at least one tapered interlaced joint (3) incorporated at either one, or both termini of the panels according to need and/or a user's desire. Such a tapered interlaced joint (3) as shown by example in FIG. 7, may present a flared extension, which may be formed used using standard machining techniques known in the industry, from a single wood plank reducing complexity, cost and providing a solid joint forming structure more adaptable to a variety of structures.

Figure 7:
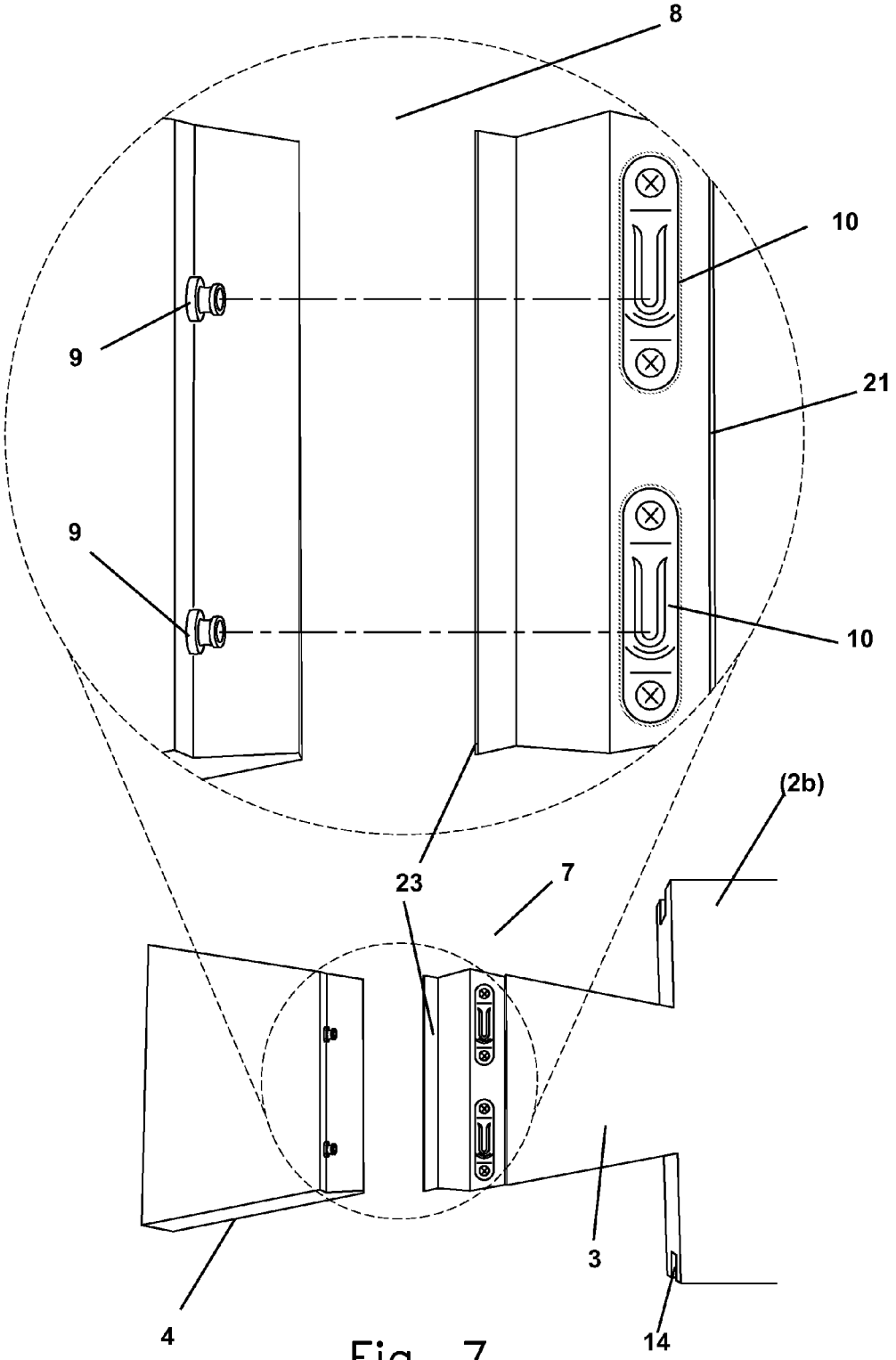
FIG. 7: is a front perspective view of a fitted corner joint with a blow-up front view of an internal connection in one embodiment thereof.

As shown in FIG. 7 specifically, in a preferred embodiment, the internal terminal surface may provide for a fitted corner joint (7) facilitating the corner attachment of at least one terminal facade cap (4). As it may be desired to secure said terminal facade cap (4) to a tapered interlaced joint (3) in a corner joint such that it outwardly presents an unaltered end-grain surface (5) to the viewer, in a preferred embodiment, a separate wood component, for example, may be horizontally cut to create such a terminal facade cap (4) with a prepared end-grain surface (5) portion for outward presentation. To further enhance the end-grain surface (5) presentation, said tapered interlace joint (3) may have a tapered panel terminus (23) as well as an interior guide edge (24). As shown generally in FIG. 7, the terminal end of the tapered interlace joint (3) may be angle cut so as to taper to a point so as to present a minimal end-grain surface—the terminal facade cap (4) being also angle cut to create said fitted corner joint (7). Further, as shown in FIG. 7, the internal surface of a tapered interlaced joint (3) may have an interior guide edge (24) that may abut the internal surface of the terminal facade cap (4) and help provide a flush joint. This interior guide edge (24) may further provide a leading edge to guide placement and sliding of said terminal facade cap (4) onto the tapered interlace joint (3) as described herein.

In some embodiments a terminal facade cap (4), and corresponding tapered interlaced joint(s) (3) on said composite siding panel (1) may be shaped to create a fitted miter joint (27). In a preferred embodiment, both the terminal facade cap (4) and tapered interlaced joint (3) elements may be angle cut and shaped with corresponding integral protrusions (30) and notches or grooves (31) to form such a fitted miter joint (27). In a preferred embodiment, a tapered interlaced joint (3) may be cut at an inward angle, perhaps approximately 16° degrees to provide an appropriate angled surface for attachment of a correspondingly cut terminal facade cap (4). Such an integral fitted miter joint (27) may initially provide an installation guide for the consistent placement of said terminal facade cap (4) to a tapered interlaced joint (3). In addition, such fitted miter joint (not shown) may also provide multi-directional stability and increased structural integrity. Such a fitted miter joint (27) may further be secured through the use of known fasteners and/or adhesives such as wood glue. Additional embodiments contemplated may include a standard flat miter joint (not shown) joining the terminal facade cap (4) and tapered interlaced joint (3) surface. In an additional embodiment, an external spline (not shown) may be inserted into the lateral surface intersecting the fitted miter joint (27) or standard flat miter joint to provide an additional placement guide for the terminal facade cap (4). Such a spline may also be internally positioned in some embodiments.

Referring again to FIG. 7, in a preferred embodiment, as described above at least one terminal facade cap (4) presenting an end-grain surface (5) may be secured to a tapered interlaced joint element (3) forming a fitted corner joint (7) having a continuous interlaced joint surface (6) on its upper and lower surfaces. In a preferred embodiment, said terminal facade cap (4) may be secured to tapered interlaced joint element (3) through at least one internal connection (8). In a preferred embodiment, such connection (8) may comprise an internal corner joint fastener (9) secured to said terminal facade cap (4) which may be fitted to at least one internal connector (10) on said tapered interlaced joint (3). In a preferred embodiment, such internal connection (8) may be a slide connection with, for example, a slide fastener anchored to the internal side of terminal facade cap (4) which corresponds to a slide connector positioned on a tapered interlaced joint (3). As can be appreciated, such a slide fastener element may be inserted, in an off-set manner, into a slide connector element and then slide adjusted into a flush position. For example, as shown in FIG. 7, an internal corner joint fastener (9) may encompass a plurality of self-tapping metal slide fasteners with a flared element exposed anchored into a planar facade on the internal surface of a terminal facade cap (4). Such internal corner joint fasteners (9) may be inserted into, for example an internal connector (10) and slide into position, as shown in FIG. 7, forming a fitted corner joint (7). In a preferred embodiment, such an internal connector (10) may include a slide connector secured in a pre-fabricated recess position allowing the flush placement of the terminal facade cap (4) and tapered interlaced joint (3).

In this manner, such a fitted corner joint (7) has several advantages: 1) such a system provides for easier installation as well as removal and replacement; 2) such a anchored slide system is more resistant to downward sheer force which would typically be common to such end-pieces from, for example, a person placing their weight or other load force on the top of a terminal facade cap; 3) such a anchored slide system is more resistant to a push/pull force exerted on the terminal facade cap; 4) such a corner fitted joint can be sealed and stained to prevent weathering, but still be removable and replaceable; 5) such a corner fitted joint doesn't require glues or other adhesives which cannot be easily removed, or may damage the joint when removed; however, it should be noted that such joints may still be secured with wood glues or other adhesives, however, such slide mechanism allows for easier sheer severing of any adhesive joint as less adhesive will be required in the first place; 6) the terminal facade caps may be added after placement of composite siding panels and even after performing any required joint working; and 7) it doesn't require addition of securing splines altering the end or side grain presentation.

However, it should be noted that as described above, said fitted corner joint (7) may if desired include a spline secured corner joint such that a terminal facade cap (4) may be secured to a tapered interlaced joint element (3) through at least one spline. In some embodiments this spline may be maybe placed internally or externally and secured using traditional techniques known in the industry. It should be noted that the invention expressly contemplates the above referenced internal connection (8) and its embodiments may be used in conjunction with internal as well as external spline supports.

Additional embodiments of the invention as shown in FIGS. 2-4, may include for example a terminal end-cap support (22), such as a plywood insert that may be secured to the internal surface of a terminal facade cap (4). Such a terminal end-cap support (22) may be secured by traditional wood glues or other adhesives as well as self-tapping screws or nails and the like. In some embodiments such a terminal end-cap support (22) may be secured to a terminal facade cap (4) or even tapered interlace joint (3) with an internal or external spline. Such an embodiment may provide additional structural integrity, especially when placed in a recessed configuration, but may also provide additional cost savings as the terminal facade cap (4) will typically be made of commodity woods to present an aesthetically pleasing end-grain surface (5). Use of such a terminal end-cap support (22) reduces the total amount of premium wood and/or wood-composite product needed while maintaining the exterior aesthetic appearance.

It should be noted that the above referenced fitted corner joints (7) and interlaced joint surfaces (6), as generally shown in FIGS. 2-5, may allow for the interlaced end-grain corner configuration of the present invention, as such interlaced joint surfaces (6) may allow composite siding panels (1) to be alternatively applied in a staggered fashion over the pre-existing surface with top and bottom edges of adjacent panels in a parallel orientation creating a chink joint, which may be filled in with caulk, insulating material or other appropriate matter known in the art post-installation. As seen in various figures, such may be interlaced with opposing and staggered fitted corner joints (7) to provide the alternative corner joint at a structures corner, while the interlaced joint surface(s) (11) may form an abutment joint between such alternating staggered siding panels (1) show in, for example, FIGS. 1 and 5.

Figure 5:
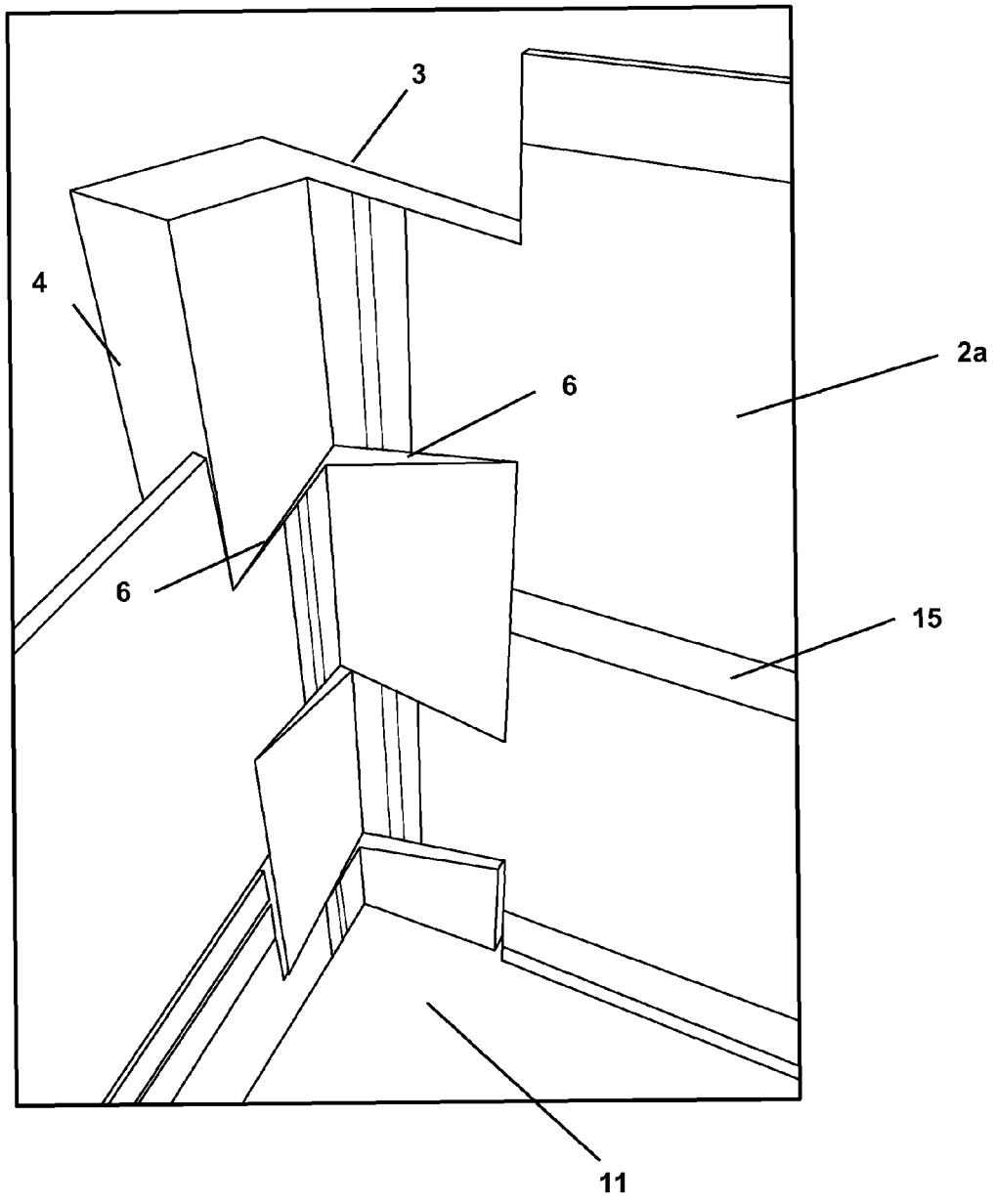
FIG. 5: is an internal perspective view of an interlaced end-grain corner joint configuration in one embodiment thereof.
Figures 6A, 6B, 6C, 6D:
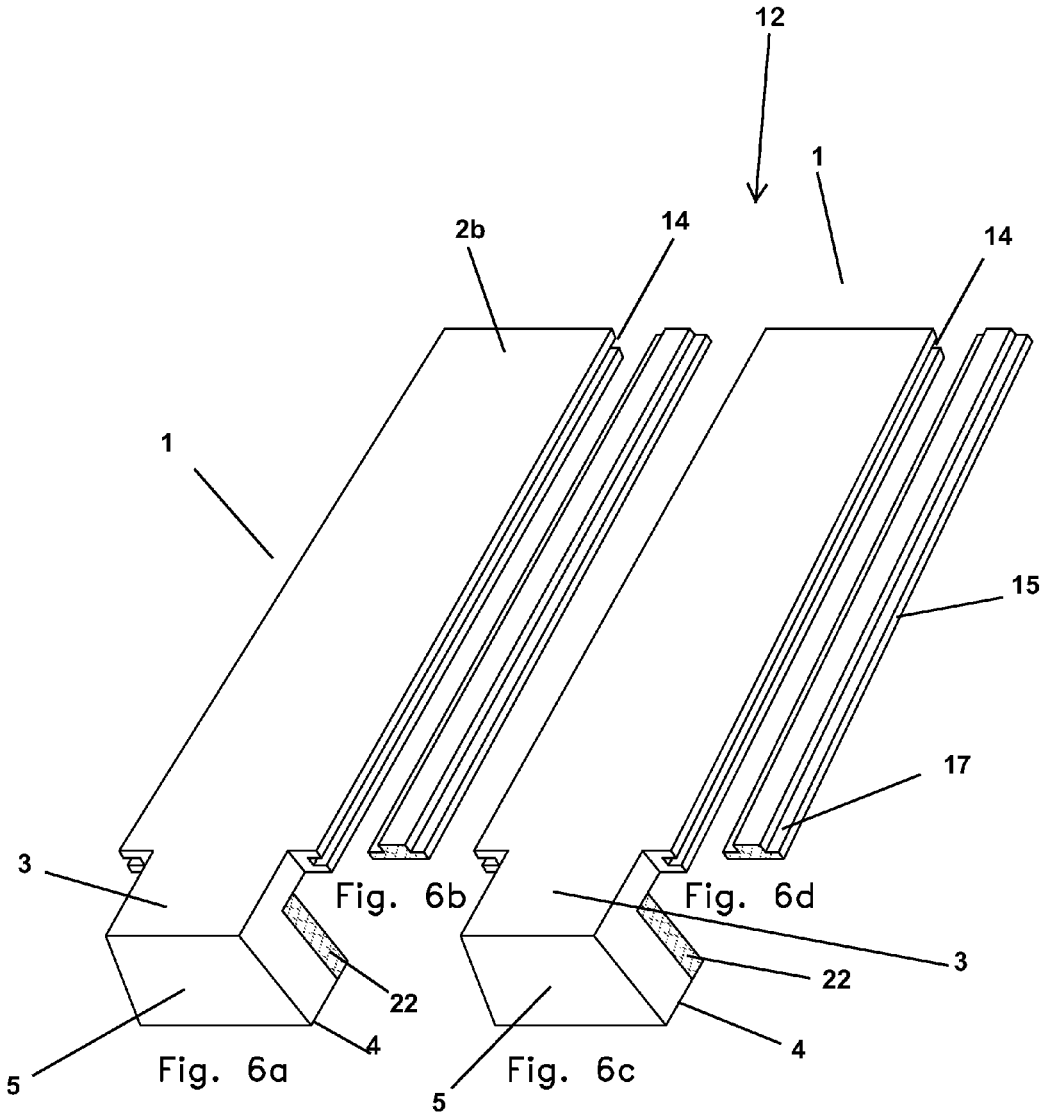
FIG. 6*a*-6*d*: are multiple external perspective views of individual composite siding elements in a stacked orientation with false chinking joint inserts in one embodiment thereof.

It should be noted that in certain embodiments the placement of such alternating fitted corner joints (7) may be placed in a recessed position. As shown in FIG. 5, the internal surfaces of the alternating fitted corner joints (7) are in a flush position such that the terminal facade cap (4) is recessed into the wall, forming a recessed interlaced end-grain corner joint configuration as opposed to the outwardly extending interlaced end-grain corner joint configuration as shown in FIG. 1 where the alternating terminal facade caps (4) are more prominently extended from the corner joint.

As show in FIGS. 1-6, the elements described above can be assembled in such a manner so as to create individual composite siding panel (1) elements that when combined and horizontally placed in an opposing and staggered fashion around the corner of a pre-existing structure may create the desired interlaced end-grain corner joint configuration (11) with a terminal facade cap (4) placed so as to outwardly present an unaltered end-grain surface (5) to more realistically represent the aesthetics of a whole-log structure. In particular, complete composite siding panels (1) may be placed in a horizontally staggered fashion to simulated the log-on-log construction such that the tapered interlaced joints (3) may mesh together at the corner in a dovetail fashion, such that alternative and opposing terminal facade cap(s) (4) may be alternatively attached to said siding panels (1) utilizing a fitted corner joint (7) among other methods as previously discussed.

More specifically, in a preferred embodiment of the current invention, the interlaced end-grain corner joint configuration (11) may be established by placing alternating staggered composite siding panels (1), that have opposing terminal facade cap(s) (4) having two opposite parallel sides with any two of the abutting sides forming a substantially right angle, and two of the opposite sides being wider than the other two opposite sides to form in cross-section a substantially rectangular portion. In this configuration terminal facade cap(s) (4) outwardly present a prepared end-grain surface (5). The tapered interlaced joints (3) are interlaced such that each is flush with the opposing interlaced joint surface (6) (whether recessed or not) with the wide end of the tapered interlaced joint (3) disposed of within the narrow end of the composite siding panels (1) opposing tapered interlaced joint (3) resisting any sheer force securing the corner configuration. As can be appreciated, horizontally placing and fitting alternating staggered composite siding panels (1) with opposing terminal facade cap(s) (4) produces the desired interlaced end-grain configuration at a corner position.

As demonstrated in FIG. 1, some embodiments may contemplate an internal opening (25), such as a typical window or door. Such openings can be surrounded with an internal opening casing (26) so as to secure the individual composite siding panels (1) flush with the pre-existing structure and to prevent any warping or separation.

Generally referring to FIGS. 2-4 and 6, the current inventive technology in some embodiments may include a system of composite siding with a false chinking joint (13). A traditional chink joint, or chinking joint, generally consists of caulk or putty applied between the horizontal gaps created by stacked whole-logs creating an external sealed barrier. In some instances fitted strips or other elements of insulation are inserted into such a void then covered in caulk or putty. However, such techniques, while consistent with traditional whole-log construction techniques are expensive as well as difficult to create and maintain.

As such, in a preferred embodiment, as discussed above, such a system may include a composite siding panel (1) having an external panel surface (**2*b*) which may be configured to present a solid and/or shaped wood log siding as well as an internal panel surface (2*a*) configured to be joined to, for example, a pre-existing surface. As shown in FIGS. 2-4, and 6, at least one lateral attachment channel (14), which may, in some embodiments be an integral groove or slot, may be established on said the lateral edge of the body of a composite siding panel (1). Such an embodiment may further include a false chinking joint insert (15) which may include at least one false chinking joint insert attachment (17) configured, in this embodiment as a "tongue" or penetration to be secured into said lateral attachment channel (14) securing adjacent composite siding panels (1) and providing a variable space between the staked panels. Presented on the external surface in-between the stacked composite side panels (1) may be a false chinking joint surface (16**), having at least one layer of elastomeric material affixed to its external surface providing the appearance of a traditional chinking joint.

It should be noted that in this instance, the terms elastomeric material may encompass a variety of materials including specific elastomers, those being generally elastic polymers, as well traditional surface coverings such as paint, insulation, epoxy, caulk and putty and any combination of the like. Specific example may include, but are not limited too: epoxy, putty, caulk, insulating material, paint; elastomeric paint; elastomeric coating; rubber, saturated rubber; unsaturated rubber; thermoplastic; and elastomeric caulk. It should further be noted that regardless of the elastomeric material used, or combination thereof, in a preferred embodiment the false chinking joint surface (16) may present the color, texture and appearance of a traditional chink joint. Such elastomeric material may be pre-applied to the false chinking joint insert (15) post-installation. In addition, such a configuration allows for additional follow-on addition of elastomeric material which may wear or fade with time. Additional sealants may be provided to seal the space between the false chinking joint insert (15) and the lateral attachment channel (14) to mitigate or prevent water seepage and/or separation.

Figure 8:
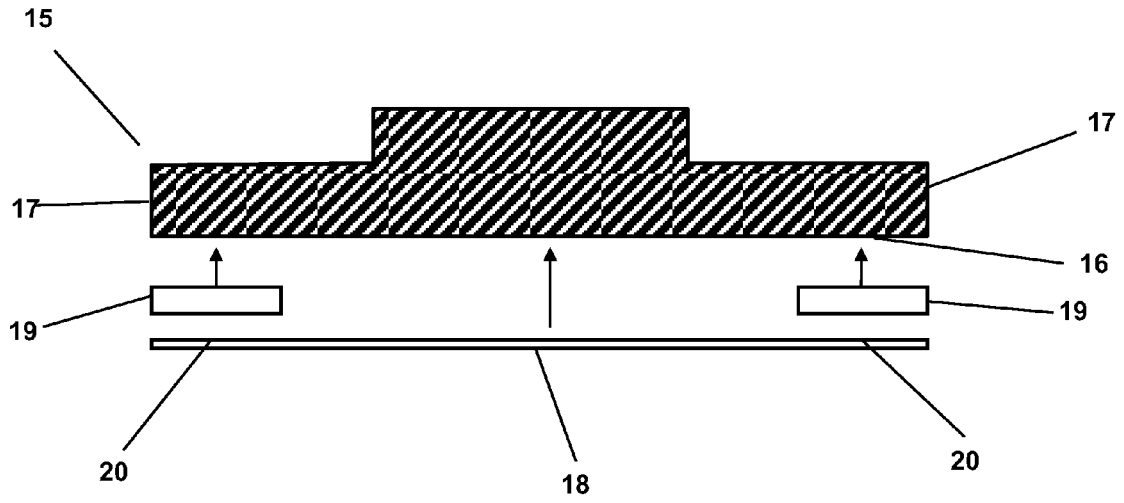
FIG. 8: if a side-perspective expanded view of a false chinking joint insert with a representative layer of non-adhesive material and a layer of elastomeric material in one embodiment thereof.
Figure 9:
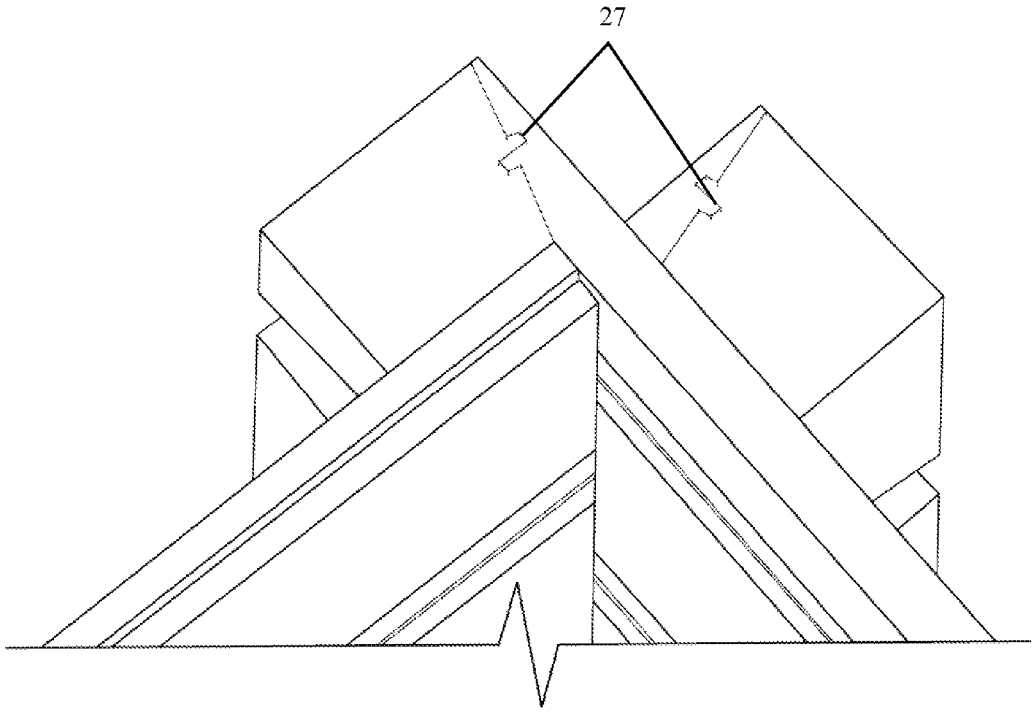
FIG. 9: is a top perspective view of a wall constructed from said composite 5 siding with interlaced end-grain corner configuration in one embodiment thereof.
Figure 10:
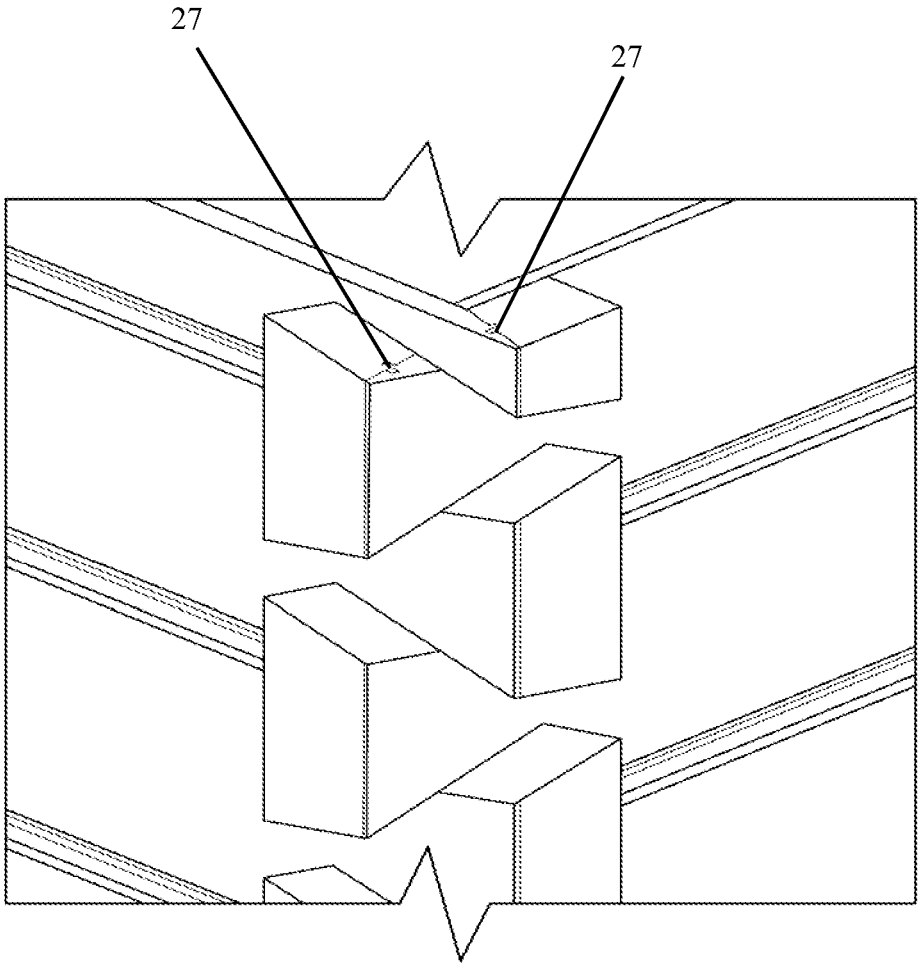
FIG. 10: is s front perspective view of an interlaced end-grain corner configuration in one embodiment thereof.
Figure 11:
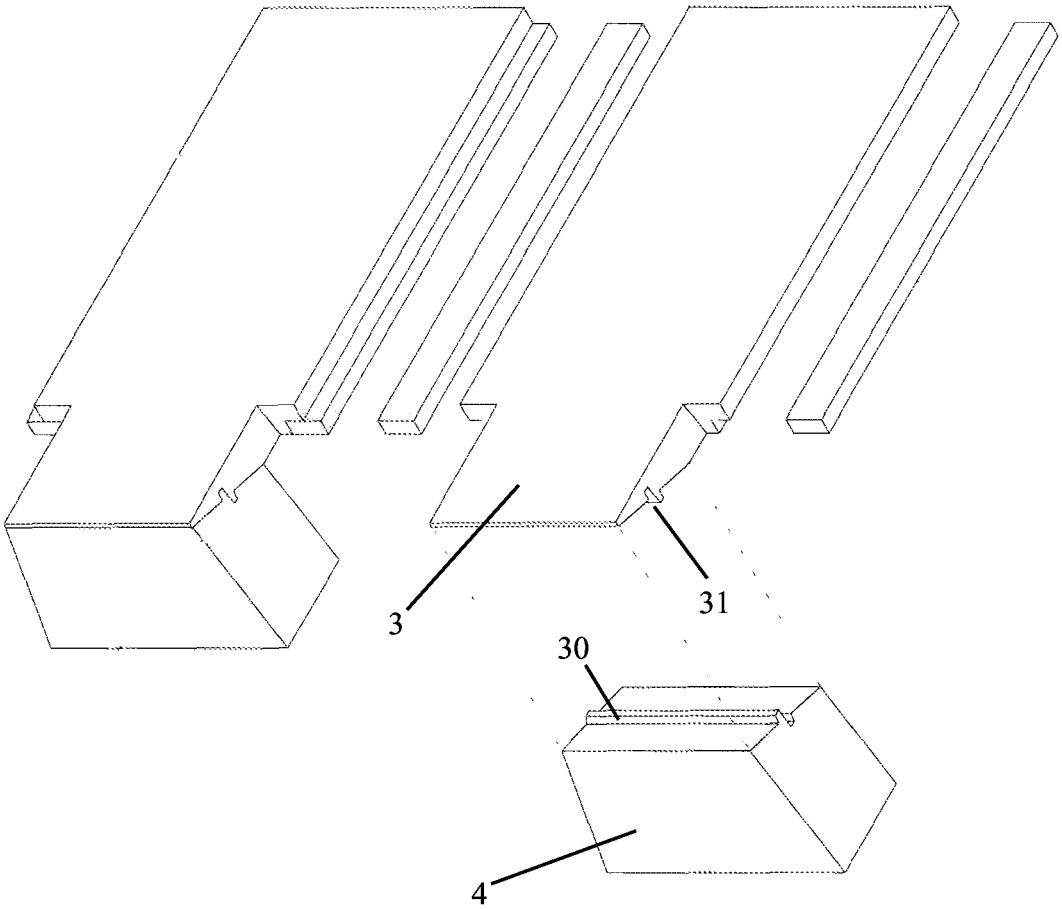
FIG. 11: shows multiple external perspective views of individual composite siding elements in a stacked orientation and an example of a fitted miter joint in embodiments thereof.

Finally, referring to FIG. 8, certain embodiments may include a pliant false chinking joint (29). As described in one embodiment above, a false chinking joint (13) may be formed by placement of a false chinking joint insert (15) into a lateral attachment channel (14) joining disparate composite siding panels (1). This joint may be fitted, or may be secured with traditional materials such as putty and epoxy and the like. However, in some instances, especially over time, cracking and wear will develop and water seepage may occur in the joint recess causing water adsorption/penetration into for example the wood. This water adsorption/penetration may further cause expansion of the wood which may comprise the false joint and/or elastomeric material.

Such expansion can be especially damaging in colder locations where freezing may follow water adsorption/penetration. To mitigate such concerns, the current invention, in some embodiments may include, at least one layer of non-adhesive material (19) affixed along the lateral edges of said false chinking joint surface (16). The term non-adhesive may broadly include a variety of materials. In certain embodiments, the terms should be understood to encompass a layer of material that is either non-adhesive to the elastomeric material (18) applied to the false chinking joint surface (16), or has a lower attachment profile. In some instances this is the result of a chemical/electrical repellant effect, or in other instances due to the non-adhesive material being merely transiently adhesive such that it may detach in response to the expansion movement from water adsorption/penetration. Other embodiments may include material that is degradable over time. Examples of such non-adhesive material (19) may include but of are not limited too: Mylar (biaxially-oriented polyethylene terephthalate); Teflon coating (Polytetrafluoroethylene); Teflon tape; tape; degradable coating; silicone; fluorocarbon coating; nylon; bio-degradable coating; water-degradable; plastic coating; and rubber. Further, as can be appreciated, the form of such non-adhesive material (19) is broadly construed as well, such that it contemplates spray applications, direct applications, non-adhesive strips or liquid applications.

Again referring to FIG. 8, as shown, the application of an elastomeric (18) over said layer of non-adhesive material (19) may create a partially detached surface (20). When for example water adsorption/penetration occurs—causing expansion and/or distortion of the joint and/or insert elements—as a result of the detached surface, transmission of the tensional stress placed on the elastomeric material (18)—as a result of this expansion of the joint or insert—may be reduced and/or eliminated.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the statements of invention. As can be easily understood from the foregoing, the basic concepts of the present invention may be embodied in a variety of ways. It involves both apparatus for composite siding with an improved interlaced end-grain corner configuration, false chinking joint, and false chinking joint internal expansion apparatus embodiments as well as techniques of use as well as devices and techniques to accomplish the same. In this application, these embodiments are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims that will be included in any subsequent patent application.

It should also be understood that a variety of changes may be made without departing from the essence of the invention. Such changes are also implicitly included in the description. They still fall within the scope of this invention. A broad disclosure encompassing both he explicit embodiment(s) shown, the great variety of implicit alternative embodiments, and the broad methods or processes and the like are encompassed by this disclosure and may be relied upon when drafting any claims. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "fastener" should be understood to encompass disclosure of the act of "fastening"—whether explicitly discussed or not—and, conversely, were there effectively disclosure of the act of "fastening", such a disclosure should be understood to encompass disclosure of a "element" and even a "means for fastening." Such changes and alternative terms are to be understood to be explicitly included in the description.

Any patents, publications, or other references mentioned in this application for patent are hereby incorporated by reference. Any priority case(s) claimed by this application is hereby appended and hereby incorporated by reference. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in Information Disclosure Statement or other information statement later filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant(s).

Thus, the applicant(s) should be understood to have support to claim and make a statement of invention to at least: i)

a system of composite siding with improved interlaced end-grain corner configuration and false chinking joint with internal expansion embodiments as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) the various combinations and permutations of each of the elements disclosed, xii) each potentially dependent claim or concept as a dependency on each and every one of the independent claims or concepts presented, and xiii) all inventions described herein.

With regard to claims whether now or later presented for examination, it should be understood that for practical reasons and so as to avoid great expansion of the examination burden, the applicant may at any time present only initial claims or perhaps only initial claims with only initial dependencies. Other claims may be preserved within the specification as clauses. The office and any third persons interested in potential scope of this or subsequent applications should understand that broader claims may be presented at a later date in this case, in a case claiming the benefit of this case, or in any continuation in spite of any preliminary amendments, other amendments, claim language, or arguments presented, thus throughout the pendency of any case there is no intention to disclaim or surrender any potential subject matter. It should be understood that if or when broader claims are presented, such may require that any relevant prior art that may have been considered at any prior time may need to be re-visited since it is possible that to the extent any amendments, claim language, or arguments presented in this or any subsequent application are considered as made to avoid such prior art, such reasons may be eliminated by later presented claims or the like. Both the examiner and any person otherwise interested in existing or later potential coverage, or considering if there has at any time been any possibility of an indication of disclaimer or surrender of potential coverage, should be aware that no such surrender or disclaimer is ever intended or ever exists in this or any subsequent application. Limitations such as arose in *Hakim v. Cannon Avent Group, PLC,* 479 F.3d 1313 (Fed. Cir 2007), or the like are expressly not intended in this or any subsequent related matter. In addition, support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible. The use of the phrase, "or any other claim" is used to provide support for any claim to be dependent on any other claim, such as another dependent claim, another independent claim, a previously listed claim, a subsequently listed claim, and the like. It should be understood that this phrase also provides support for any combination of elements in the claims and even incorporates any desired proper antecedent basis for certain claim combinations such as with combinations of method, apparatus, process, and the like claims. Furthermore, it should be noted that certain embodiments of the current invention may indicate a fastener, or the step of fastening. It should be noted that these may indicate a direct or in some cases an indirect connection and/or bringing together of disparate or non-disparate elements in a functional, non-functional or desired configuration.

Finally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The invention claimed is:

1. A composite siding panel with improved interlaced end-grain corner configuration comprising:

a plurality of siding panels having:

an external panel surface configured to present a solid planar wood log siding;

an internal panel surface configured to be joined to a pre-existing surface through a siding panel stacking attachment; and at least one integral tapered interlaced joint element having no end-grain presentation;

at least one terminal facade cap presenting an continuous end-grain surface perpendicularly secured to said tapered interlaced joint element forming a continuous interlaced joint surface wherein said integral tapered interlaced joint elements are physically interlaced one with another such that said continuous end-grain surface is alternatively presented when composite siding panels are stacked forming said interlaced end-grain corner joint configuration; and an integral fitted miter joint securing said terminal facade cap presenting an continuous end-grain surface perpendicularly to said tapered interlaced joint element;

wherein said terminal façade caps each presenting said continuous end-grain surface are alternatingly stacked to create an outwardly extending interlaced end-grain corner joint configuration where said terminal façade caps completely extend past adjacent stacked external panel surfaces.

2. A composite siding panel with improved interlaced end-grain corner configuration as described in claim 1 wherein said siding panel comprises a siding panel selected from the group consisting of: wood siding panel, plywood siding panel, plywood-wood hybrid siding panel, synthetic siding panel wood, and wood plastic composite.

3. A composite siding panel with improved interlaced end-grain corner configuration as described in claim 2 wherein said wood plastic composite comprises a wood-plastic composite wherein the plastic portion of said composite is selected from the group consisting of: high-density polyethylene, low-density polyethylene, polyvinyl chloride (PVP), polypropylene (PP), acrylonitrile butadiene styrene (ABS), polystyrene (PS), polylactic acid (PLA), thermoplastic, and recycled thermoplastic.

4. A composite siding panel with improved interlaced end-grain corner configuration as described in claim 1 wherein said tapered interlaced joint element comprises a tapered panel terminus.

5. A composite siding panel with improved interlaced end-grain corner configuration as described in claim 1 wherein said tapered interlaced joint element comprises an interior edge guide.

6. A composite siding panel with improved interlaced end-grain corner configuration as described in claim 1 and further comprising at least one internal corner joint fastener.

7. A composite siding panel with improved interlaced end-grain corner configuration as described in claim 6 wherein said internal corner joint fastener comprises at least one slide fastener.

8. A composite siding panel with improved interlaced end-grain corner configuration as described in claim 7 wherein said slide fastener comprises at least one recessed slide connector.

9. A composite siding panel with improved interlaced end-grain corner configuration as described in claim 1 wherein said siding panel stacking attachment comprises at least one non-integral siding panel stacking attachment secured to a pre-existing surface.

10. A composite siding panel with improved interlaced end-grain corner configuration as described in claim 1 wherein said siding panel stacking attachment comprises at least one surface attachment element.

11. A composite siding panel with improved interlaced end-grain corner configuration as described in claim 1 wherein said siding panel stacking attachment comprises a grooved attachment.

12. A composite siding panel with improved interlaced end-grain corner configuration as described in claim 1 wherein said integral fitted miter joint comprises at least one shaped integral protrusion and corresponding groove on said terminal façade cap and said tapered interlaced joint element.

13. A composite siding with a false chink joint comprising:

at least one composite siding panel having:

an external panel surface configured to present a solid planar wood log siding;

an internal panel surface configured to be joined to a pre-existing surface;

at least one integral tapered interlaced joint element having no end-grain presentation; and at least one lateral attachment channel;

at least one terminal facade cap presenting an continuous end-grain surface perpendicularly secured to said tapered interlaced joint element forming a continuous interlaced joint surface wherein said integral tapered interlaced joint elements are physically interlaced one with another such that said continuous end-grain surface is alternatively presented when composite siding panels are stacked forming said interlaced end-grain corner joint configuration;

a integral fitted miter joint securing said terminal facade cap presenting an continuous end-grain surface perpendicularly to said tapered interlaced joint element;

at least one false chink joint insert having:

at least one false chink joint insert attachment configured to be secured into said lateral attachment channel of said composite siding panel securing composite siding panels; and a false chinking joint surface externally presented between said joined composite siding panels; and at least one layer of elastomeric material affixed to the external surface of said false chinking joint surface externally presenting the appearance of a chink joint;

wherein said terminal façade caps each presenting said continuous end-grain surface are alternatingly stacked to create an outwardly extending interlaced end-grain corner joint configuration where said terminal façade caps completely extend past adjacent stacked external panel surfaces.

14. A composite siding with a false chinking joint as described in claim 13 wherein said elastomeric material comprises elastomeric material selected from the group consisting of: epoxy, putty, caulk, insulating material, paint, elastomeric paint, elastomeric coating, rubber, saturated rubber, unsaturated rubber, thermoplastic, and elastomeric caulk.

15. A composite siding panel with improved interlaced end-grain corner configuration as described in claim 13 wherein said integral fitted miter joint comprises at least one shaped integral protrusion and corresponding groove on said terminal façade cap and said tapered interlaced joint element.

16. A pliant false chink joint comprising:

at least one siding panel having at least one lateral attachment channel, at least one false chink joint insert having:

a false chink joint insert attachment wherein said attachment is configured to be secured into said lateral attachment channel; and a false chink joint surface externally presented between joined composite siding panels;

at least one layer of non-adhesive material affixed to the surface of the lateral edges of said false chink joint insert attachment; and at least one layer of elastomeric material affixed to the external surface of said false chinking joint surface wherein elastomeric material does not adhere to said non-adhesive material affixed to the surface of the lateral edges of said false chink joint insert attachment forming a partially detached elastomeric surface along the lateral edges of said false chink joint insert attachment corresponding with the placement of said non-adhesive material wherein said non-adhesive material is configured to become detached from said elastomeric material in response to expansion and/or contraction of said siding panel or said false chink joint insert attachment.

17. A pliant false chink joint as described in claim 16 wherein said elastomeric material comprises elastomeric material selected from the group consisting of: epoxy, putty, caulk, insulating material, paint, elastomeric paint, elastomeric coating, rubber, saturated rubber, unsaturated rubber, thermoplastic, and elastomeric caulk.

18. A pliant false chink joint as described in claim 16 wherein said non-adhesive material comprises non-adhesive material selected from the group consisting of: biaxially-oriented polyethylene terephthalate, polytetrafluoroethylene coating, polytetrafluoroethylene tape, tape, degradable coating, silicone, fluorocarbon coating, nylon, bio-degradable coating, water-degradable coating, plastic coating, and rubber.

19. A pliant false chink joint as described in claim 16 wherein said non-adhesive material comprises at least one non-adhesive biaxially-oriented polyethylene terephthalate strip.

* * * * *